United States Patent [19]

Schloss et al.

[11] Patent Number: 4,653,424

[45] Date of Patent: Mar. 31, 1987

[54] CRACK SEALER MACHINE

[76] Inventors: Dennis L. Schloss, 311 8th Ave. East; Anton C. Hendrickson, 704 Custer, both of Dickinson, N. Dak. 58601

[21] Appl. No.: 797,996

[22] Filed: Nov. 14, 1985

[51] Int. Cl.[4] ..... B05C 11/04; B05C 5/00

[52] U.S. Cl. ..... 118/108; 118/305

[58] Field of Search ..... 118/305, 108; 404/107, 404/108; 15/401, 320

[56] References Cited

U.S. PATENT DOCUMENTS 1,751,565 3/1930 Talbott ..... 222/146.1 X
3,280,710 10/1966 Glade ..... 404/107
3,663,985 5/1972 Burgoon ..... 15/320 X
4,471,713 9/1984 Cote et al. ..... 118/108

*Primary Examiner*—John P. McIntosh
*Attorney, Agent, or Firm*—Shlesinger Arkwright Garvey & Fado

[57] ABSTRACT

A crack filling apparatus which is light weight, easy to assemble and easy to maneuver includes a support frame having a pivot intermediate the frame forward and rearward end. A tank means for holding a crack filling medium is supported at the forward end. Squeegee means is pivoted about said pivot coaxial with the shafts of the wheel means. A handle is provided with control means to regulate the squeegee means and the flow of crack filling medium from the tank.

18 Claims, 5 Drawing Figures

CRACK SEALER MACHINE

BACKGROUND OF THE INVENTION

This invention relates in general to light-weight portable devices for filling cracks and expansion joints in pavement or the like.

In the past, portable devices for filling cracks in pavement or the like either had wheels and were designed to be pushed or pulled or, were of the type to be hand-carried. Crack filling devices of the prior art were known to have several disadvantages. For example, U.S. Pat. No. 1,139,844 issued to Calnan teaches a portable device for distributing a binding and filling material into the crevasses or joints between rows of paving blocks and the like. The Calnan device is extremely awkward bulky and difficult to maneuver. For instance, the reservoir A is extremely large, thereby, giving the device a large capacity. However, the added weight makes the device difficult to maneuver and potentially unstable. The provision of only two wheels, without any other support means makes it difficult for an operator to stop the device or to place the device in a rest position. The large wheels B relative to the position of the spouts E make it difficult, for a user, to maneuver the device so the spout is above the proper position and also make it difficult for the user to see where the spout is relative to the proper position.

U.S. Pat. No. 1,751,565 issued to Talbott teaches a device for spreading pitch or other bitumen in the lane of roofing felt. The device taught by Talbott is heavy, awkward and difficult to use in that the device is pulled in a manner such that it is not clear exactly where the various spouts are relative to the surface the medium is to be spread upon. The arrangement of the Talbott device is such that the medium to be distributed may be distributed over a large area. In other words, the Talbott device does not contemplate the filling of cracks in pavement or the like. Additionally, the Talbott device would be of little use with respect to the accurate filling of cracks in pavement or the like.

U.S. Pat. No. 2,420,410 issued to Blanker teaches a pavement repairing device having two wheels, a tank for holding pavement repair medium and a handle for an operator to push the device with. Although the device taught by Vlenkner is fairly maneuverable, it includes a large heating tank which adds bulk and weight to the structure.

U.S. Pat. No. 2,161,488 issued to Stewart and U.S. Pat. No. 3,280,710 issued to Glade each teach devices which are very large and bulky and are primarily designed for laying large quantities of asphalt or the like.

OBJECTS AND SUMMARY OF THE INVENTION

It is an object of the present invention to provide a light-weight portable crack filling dispenser which is easy to maneuver and easy to control.

A further object of the invention is to provide a crack filling device having a crack filling medium dispenser which can be accurately controlled and viewed by a person operating the device.

Still another object of the present invention is to provide a crack sealing apparatus having controls for varying the rate and distribution of a crack filling medium wherein the controls are located such that they are in reach of a person using the device.

Still another object of the present invention is to provide a crack sealing apparatus having a squeegee means which is easily removable and replaceable.

Still another object of the present invention is to provide a crack filling device having means for controlling the amount of crack filling medium dispensed and also means for controlling the concentration of crack filling medium dispensed.

A further object of the present invention is to provide a crack filling device having only two wheels, for increased maneuverability, and means for positioning the device in a rest position.

Still another object of the present invention is to provide a crack filling device including wheels having a contact surface of a width which is not too narrow to cut or scar the pavement but is wide enough to avoid accumulation of material thereon.

Still another object of the invention is to provide a crack filling device which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENT

Figure 1:
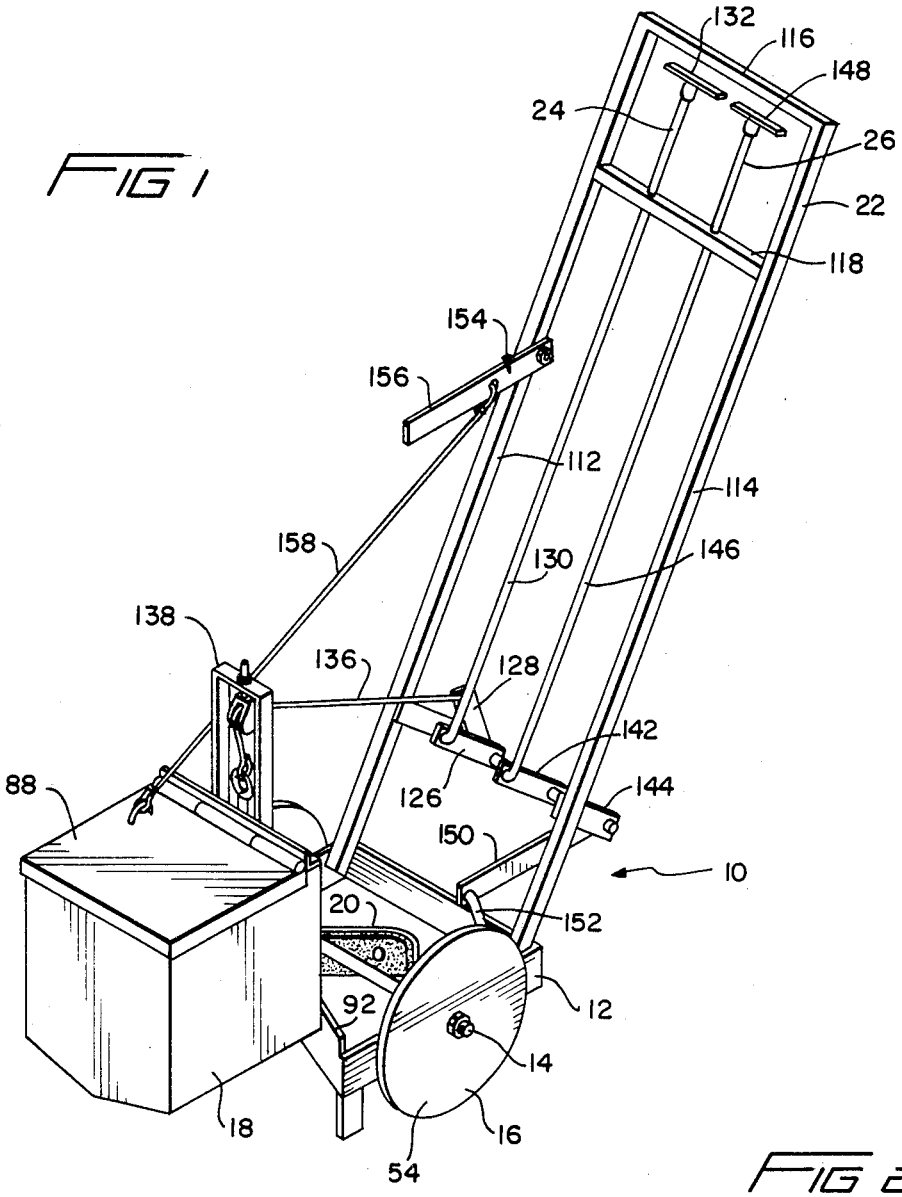
FIG. 1 is a perspective view showing the crack filling apparatus of the present invention.
Figure 2:
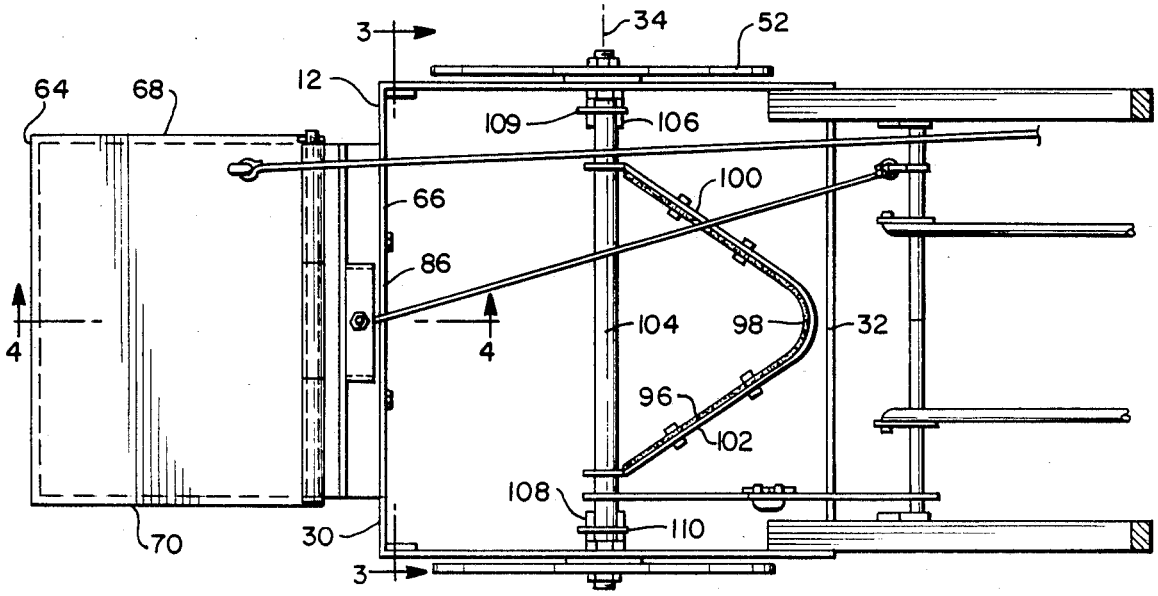
FIG. 2 is a top plan view of the crack filling apparatus fo the invention with a portion of a handle broken away.
Figure 3:
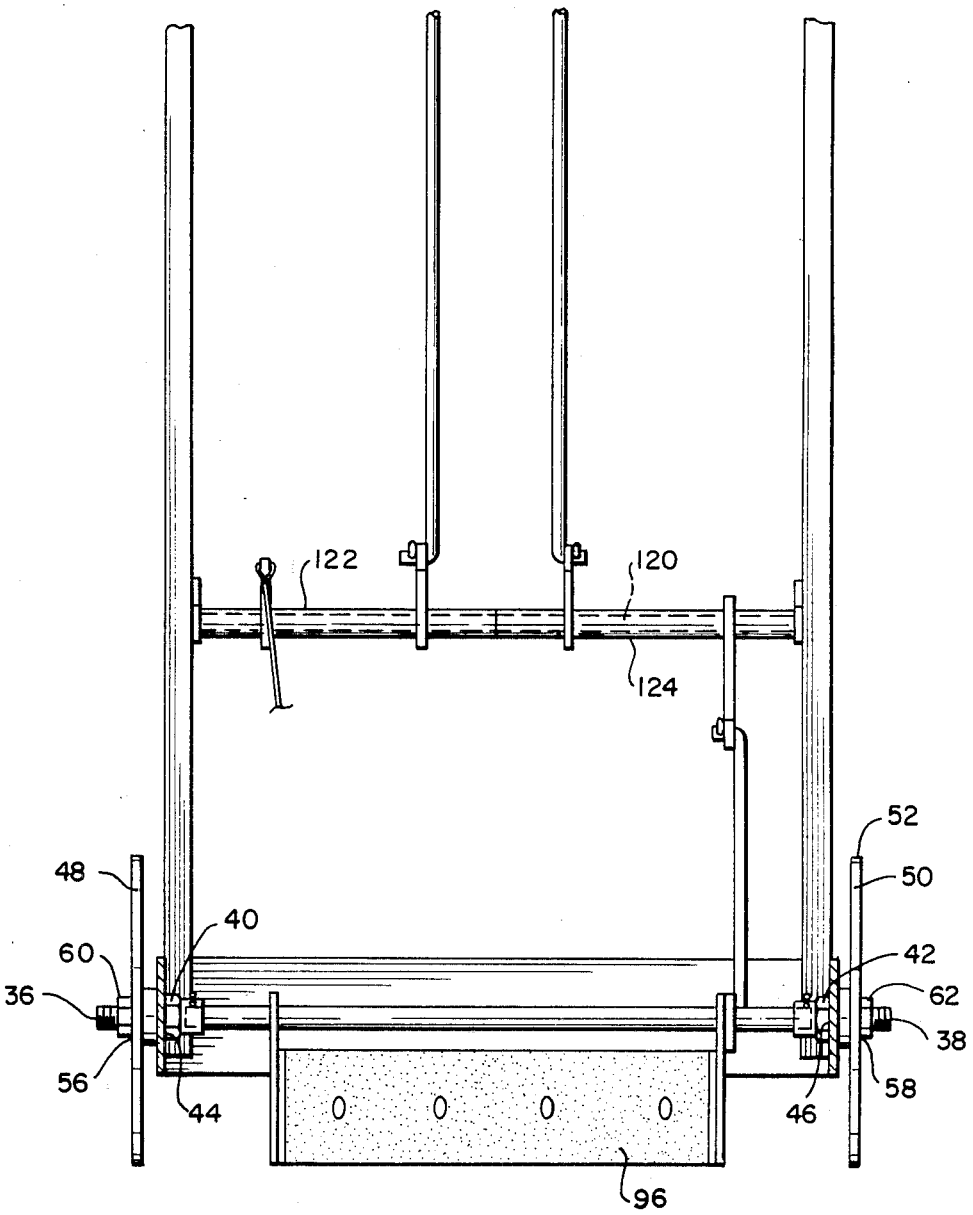
FIG. 3 is a section view taken along line 3—3.

Referring to the drawings in particular, the invention embodied therein comprises a crack filling device generally designated 10 which advantageously includes a support frame 12, axle means 14, wheel means 16, tank means 18, squeegee means 20, handle 22, a dispensing control means or dispenser control actuator 24 and squeegee actuator or squeegee control means 26.

Support frame 12 includes a forward end 30 and a rearward end 32. The frame lies generally in a plane and is adapted to pivot about a pivot line 34. Pivot line 34 is positioned intermediate the forward end 30 and rearward end 32 and preferably, pivot line 34 lies halfway between forward end 30 and rearward end 32. Axle means 14 includes a first stub shaft 36 and a second stub shaft 38. First stub shaft 36 is mounted on the exterior of support frame 12. Second stub shaft 38 is mounted on the exterior of support frame 12 opposite the side at which the first stub shaft 36 is mounted. Each stub shaft 36 and 38 is preferably a bolt having respective bolt heads 40 and 42, stub shaft 36 and 38 are preferably inserted into respective holes 44 and 46 which are defined by the support frame 12.

Wheel means 16 advantageously includes a first wheel 48 and a second wheel 50. Each of wheels 48 and 50 have a contact surface or circumferential area 52.

The contact surface 52 is preferably ¼ inch to ¾ of an inch in width. This feature is of particular importance in that if the width of the contact surface 52 is too narrow, the wheels will tend to cut or score the asphalt or pavement surface. If the contact surface 52 is to wide in width, the surface 52 would tend to accumulate material which would tend to adhear to the contact surface 52. Planar surfaces 54 extend generally perpendicular to adjacent contact surface 52. This solid planar surface 54 is provided in order to reduce the potential for the first and second wheels 48 and 50 of getting fouled with debris or the like. In other words, first wheel 48 and second wheel 50 are disk-like members.

Each of wheels 50 and 52 are secured to first and second stub shafts 36 and 38 respectively. This is done by mounting each of first wheel 48 and second wheel 50 on respective stub shafts 36 and 38 by inserting respective stub shafts 36 and 38 into wheel hub portions 56 and 58 respectively. A first nut 60 and a second nut 62 are adapted for engaging threaded portions on respective first and second stub shafts 36 and 38. By this construction, first wheel 48 and second wheel 50 are free to rotate about respective stub shafts 36 and 38 but are confined with respect to movement in an axial direction.

Tank means 18 is a generally box-shaped container having a front portion or free side 64 and a rear portion or frame side 66. The tank means has two side walls 68 and 70 in addition to a bottom portion 72 and a top portion 74. Bottom portion 72 includes an angled portion 76 extending from the free side 64, intermediate the top 74 and the bottom 72, to the frame side 66. The angled portion 76 is so constructed that there is a downward slope from the free end 64 to the frame end 66. Angled portion 76 acts within tank means 18 to provide a convenient sloping surface to direct a crack filling medium towards a spout opening 78 positioned at the frame side of the bottom of the tank.

Figure 4:
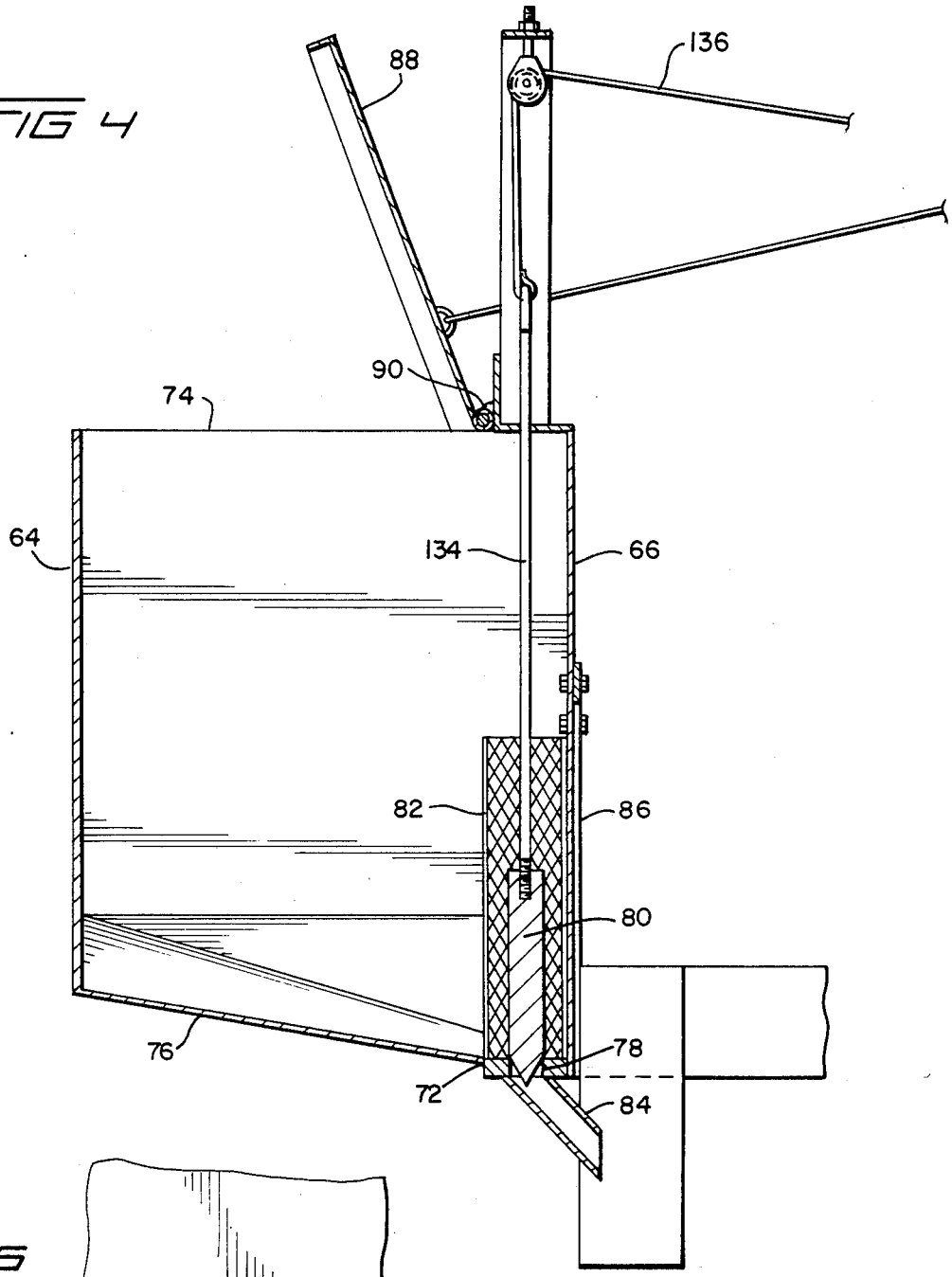
FIG. 4 is a section view taken along line 4—4.
Figure 5:
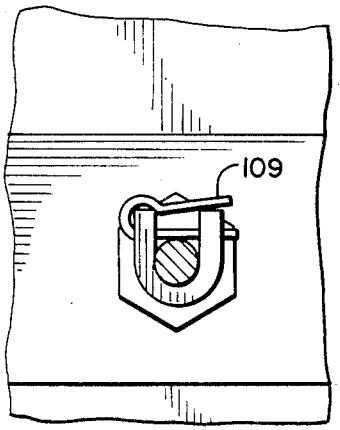
FIG. 5 is a detailed view of a U-shaped support according to the invention.

As best seen in FIG. 4, a valve needle 80 is provided within tank means 18 so as to regulate the flow of a crack filling medium through spout hole 78. Valve needle 80 is preferably formed of a cylindrical top portion and a needle shaped bottom conical portion adapted to be partially received by spout hole 78. Valve needle 80 is preferably positioned within a valve needle sleeve 82 thereby permitting the valve needle 80 to reciprocate in an up and down manner so as to allow the crack filling medium to flow through spout hole 78 when the valve needle is in an upper position and to increasingly restrict the flow of a crack filling medium as the valve needle is moved towards a bottom most position. When valve needle 80 is in the bottom most position, the crack filling medium is precluded from flowing through spout hole 78.

A pipe or spout member 84 is provided to direct the crack filling medium to the crack to be filled. Spout 84 is aligned at spout hole 78, at one end, whereas the other end terminates intermediate the pivot line 34 and the forward end 30.

Forward end 30 is conveniently provided with an angled support section 86. Angled support section 86 may be bolted or the like to the frame 66 of tank means 18. Top portion 72 of tank means 18 is conveniently provided with a lid 88 pivotable about a hinge 90. By this construction, the tank means 18 may be filled with crack filling medium and then closed so as to prevent spillage or contamination of the crack filling medium.

Tank means 18 is secured to support frame 12 by means of a V-shaped support bracket 92. The V-shape of support bracket 92 enables the support frame 12 to support the tank means 18 forward of forward end 30 of support frame 12. Tank means 18 is preferably bolted to V-shaped support bracket 92.

Squeegee means 20 includes a generally V-shaped squeegee member having a rearward V-shaped end or center portion 98 and two side front portions 100 and 102. Front side portion 100 is affixed to one side of a squeegee pivot rod 104 and front end portion 102 is fixed to the other side of squeegee pivot rod 104. By this construction, the movement of the squeegee pivot rod 104 causes the V-portion 98 of the squeegee member 96 to be moved as a function of the movement of squeegee pivot rod 104.

Squeegee pivot rod 104 is mounted coaxial with axle means 14 and more particularly, squeegee pivot rod 104 is preferably mounted on U-shaped members 106 and 108 which are integral with bolts 40 and 42 respectively. The use of U-shaped members 106 and 108 allows a user of the crack filling apparatus to change the squeegee means 20 with little difficulty. For example, to remove squeegee means 20, the user simply removes cotter pins 109 and 110, or like securing means, from respective U-shaped members 106 and 108. This enables the user to simply lift the squeegee means out of its position within the U-shaped members. By this construction, the V-portion 98 of squeegee members 96 may be reciprocated between a position which is closer to frame 12 and a position which is further away from frame 12 by pivoting the pivot rod 104. Advantageously, the axis of pivot rod 104 is coincident with pivot line 34.

Handle 22 is formed of two handle support members 112 and 114 which are fixed to respective sides of support frame 12. According to the preferred embodiment, handle supports 112 and 114 are disposed at an angle to the plane of support frame 12. Two lateral support members 116 and 118 are provided to force the structure of the handle 22. Traversing the distance from support member 112 to 114 adjacent the support frame 12 there is provided a control pivot bar 120. Control pivot bar 120 acts to strengthen the handle 22 but also acts as an axis about which two sleeve members 122 and 124 are positioned. Dispensing control means 24 comprises sleeve member 122 and a control linkage arm 126 and a controlled linkage arm 128. Control linkage arm 126 is operably connected to control linkage rod 130 which is attached to control handle knob 132. Controlled linkage arm 128 is operably connected to controlled linkage rod 134 by means of a wire or the like. 136. Wire 136 passes over a pulley suspended on pulley support 138. Controlled linkage rod 134 is connected to valve 80 so that controlled linkage rod 134 and valve 80 move together as one unit. By this construction of dispensing control means 24, the movement of control handle knob 132 moves control linkage arm 126 by means of control linkage rod 130. The movement of control linkage arm 126 causes sleeve member 122 to rotate about pivot member 120 which in turn causes attached controlled linkage arm 128 to move relative to pivot member 120. This in turn causes tension in wire 136 which operates on controlled linkage rod 134 so as to unseat needle valve 80 an amount proportional to the amount control handle knob 132 is moved.

Squeegee control means 26 comprises sleeve member 124 having a control linkage arm 142 and a controlled linkage arm 144 attached thereto. Control linkage arm 142 is operably connected to controlled linkage rod 146 which is attached to control handle knob 148. Controlled linkage arm 144 is operably connected to squeegee linkage arm 150—attached to pivot squeegee pivot rod 104 by controlled linkage rod 152. By this squeegee control means construction, the movement of control handle knob 148 causes control linkage arm 142 to be moved through control linkage rod 146. The movement of control linkage arm 142 causes sleeve member 124 to rotate about pivot member 120 thereby causing controlled linkage arm 144 to move relative to pivot member 120. The movement of controlled linkage arm 144 causes squeegee linkage arm 150 to move by means of the controlled linkage rod 152. The movement of squeegee linkage arm 150 causes squeegee pivot rod 104 to move thereby allowing squeegee member 96 to move relative to the plane of support frame 12.

Advantageously, there is also provided a control means 154 which when activated opens and closes lid 88. Lid control means 154 is comprised of a lid handle and linkage arm 156 which is operably connected to the lid 88 by means of a wire 158. Wire 158 is preferably attached to the portion of lid 88 opposite hinge 90. By this contruction of lid control 154 movement of lid linkage handle 156 causes tension in wire 158 thereby causing lid 88 to pivot about hinge 90 into an open position.

While this invention has been described as having preferred design, it is understood that it is capable of further modification, uses and/or adaptations of the invention following in general the principle of the invention and including such departures from the present disclosure as come within known or customary practice in the art to which the invention pertains, and as may be applied to the essential features set forth, and fall within the scope of the invention of the limits of the appended claims.

What is claimed is:

1. A crack filling apparatus comprising:
(a) a support frame, lying in a plane, having a forward end and a rearward end and a pivot intermediate said forward end and said rearward end;
(b) axle means supported by said frame at said pivot;
(c) wheel means associated with said axle means;
(d) tank means, supported by said frame at said forward end, for dispensing a crack filling medium;
(e) squeegee means, adjustably mounted along said pivot and extending behind said pivot toward said rearward end, for engaging a crack filling medium so as to insure even distribution of said crack filling medium within a crack;
(f) a handle mounted at said rearward end of said frame;
(g) dispensing control means, mounted on said handle, for controlling the dispensing rate of a crack filling medium;
(h) squeegee control means, mounted on said handle, for adjusting the position of said squeegee relative to said support frame; and,
(i) said support frame having an opening behind said tank mean whereby an individual pushing the crack filling apparatus can readily view the dispensing rate of a crack filling medium.

2. A crack filling apparatus according to claim 1, wherein:
(a) said tank means includes means for directing a crack filling medium.

3. A crack filling apparatus according to claim 2, wherein:
(a) said means for directing being integral with said tank means and making an angle with said plane of said support frame.

4. A crack filling apparatus according to claim 3, wherein:
(a) said tank means further comprises a dispenser spout for dispensing a crack filling medium.

5. A crack filling apparatus according to claim 4, wherein:
(a) said tank means has a frame side associated with said forward end of said frame, a free side opposite said frame side, a top portion and an angled bottom portion; and,
(b) said angled bottom portion extending from said free side, to said frame side.

6. A crack filling apparatus according to claim 5, wherein:
(a) said dispenser spout is positioned at said bottom and on said frame side of said tank means.

7. A crack filling apparatus according to claim 6, further comprising:
(a) a valve means, associated with said tank means, for regulating the flow of a crack filling medium through said dispenser spout.

8. A crack filling apparatus according to claim 2, wherein:
(a) said wheel means comprising a first wheel mounted on said axle means and a second wheel mounted on said axle means, each said wheel having a wheel diameter less than the distance from said forward end of said frame to said rearend of said frame.

9. A crack filling apparatus according to claim 8, wherein:
(a) each said wheel includes a contact surface having a width from between $\frac{1}{4}$ inch to $\frac{3}{4}$ of an inch.

10. A crack filling apparatus according to claim 9, wherein:
(a) each said wheel includes a planar surface adjacent said contact surface.

11. A crack filling apparatus according to claim 1, wherein:
(a) said squeegee means is a general V-shaped member having a first end, a second end and a central crack fill medium contact zone.

12. A crack filling apparatus according to claim 1, further comprising:
(a) a valve means associated with said tank means, for regulating the flow of a crack filling medium;
(b) a dispenser spout, for dispensing a crack filling medium; and,
(c) valve linkage means operably connecting said dispensing control means with said valve means.

13. A crack filling apparatus according to claim 12, wherein:
(a) said spout has a first end associated with said tank and a second free end positioned intermediate said pivot and said forward end.

14. A crack filling apparatus according to claim 1, further comprising:
(a) a tank lid means pivotably connected to said tank and positionable in a first closed position and a second open position; and,
(b) tank lid control means, mounted on said handle for adjusting the position of said tank lid relative to said tank.

15. A crack filling apparatus according to claim 1, wherein:

(a) said squeegee means is mounted along said pivot by means of two U-shaped supports; and, (b) a securing means retains said squeegee means within said U-shaped support whereby when said securing means is removed said squeegee means may be removed from said U-shaped supports.

16. A crack filling apparatus comprising:

(a) a support frame, lying in a plane, having a forward end and a rearward end and a pivot intermediate said forward end and said rearward end;

(b) axle means supported by said frame at said pivot;

(c) wheel means associated with said axle means;

(d) tank means, supported by said frame at said forward end, for dispensing a crack filling medium;

(e) squeegee means, adjustably mounted along said pivot and extending behind said pivot toward said rearward end, for engaging a crack filling medium so as to insure even distribution of said crack filling medium within a crack;

(f) a handle mounted at said rearward end of said frame;

(g) dispensing control means, mounted on said handle, for controlling the dispensing rate of a crack filling medium;

(h) squeegee control means, mounted on said handle, for adjusting the position of said squeegee relative to said support frame;

(i) said squeegee means is a general V-shaped member having a first end, a second end and a central crack fill medium contact zone; and, (j) said first end and said second end of said squeegee means are each mounted along said pivot and said central crack fill medium contact zone is located proximate said rear end.

17. A crack filling apparatus according to claim 16, wherein:

(a) said first end and said second end of said squeegee means are mounted on a squeegee pivot rod coincident with said pivot and coaxial with said axle means.

18. A crack filling apparatus according to claim 16, further comprising:

(a) a squeege pivot rod linkage means operably connected to said squeegee control means.

* * * * *